United States Patent [19]

Anhalt et al.

[11] 4,333,703

[45] Jun. 8, 1982

[54] CONTACT RETENTION ASSEMBLY

[75] Inventors: John W. Anhalt, Orange; Steven Z. Muzslay, Huntington Beach, both of Calif.

[73] Assignee: International Telephone and Telegraph Corporation, New York, N.Y.

[21] Appl. No.: 151,307

[22] Filed: May 19, 1980

[51] Int. Cl.[3] ..... H01R 4/24

[52] U.S. Cl. ..... 339/217 S

[58] Field of Search ..... 339/217 S

[56] References Cited

U.S. PATENT DOCUMENTS 3,172,721 3/1965 Kelly ..... 339/217 S

FOREIGN PATENT DOCUMENTS 1640753 1/1968 Fed. Rep. of Germany ... 339/217 S 2163807 12/1971 Fed. Rep. of Germany ... 339/217 S

*Primary Examiner*—James L. Jones, Jr.

*Attorney, Agent, or Firm*—Thomas L. Peterson

[57] ABSTRACT

A front release contact retention assembly for an electrical connector is disclosed in which the retention ring of the assembly is carried by the contact. The ring is a one-piece molded plastic part, and embodies an inner skirt and an outer skirt which surrounds the inner skirt. The inner skirt is disposed in an annular groove in the contact to retain the ring axially thereon, and the outer skirt extends rearwardly and outwardly to engage a forwardly facing abutment surface in the contact passage. The ring may embody a forwardly extending hood to protect the beams of a socket contact.

13 Claims, 5 Drawing Figures

CONTACT RETENTION ASSEMBLY

BACKGROUND OF THE INVENTION

The present invention relates generally to an electrical connector and, more particularly, to a contact retention assembly for an electrical connector.

One form of contact retention assembly utilized in the electrical connector art is a front release system in which the contact is inserted into the connector insulator from the rear and the retention mechanism for the contact is released from the front to allow withdrawal of the contact from the rear. The retention mechanism may utilize a contact retention clip which is either mounted in the contact passage, or carried by the contact. The present invention is concerned with the latter form of retention arrangement. Typically, in such an arrangement, the contact retention clip is a stamped and rolled metal ring that is mounted on the contact and embodies rearwardly and outwardly extending spring tines that engage a forwardly facing shoulder in the contact passage to restrict rearward movement of the contact therein. The tines may be released for removing the contact rearwardly from the insulator by inserting a tubular release tool into the contact passage from the front of the insulator. The following United States patents disclose contact retention assemblies of the foregoing type:

U.S. Pat. No. 3,009,130—Redslob et al.
U.S. Pat. No. 3,040,287—Agron et al.
U.S. Pat. No. 3,059,216—Cunningham
U.S. Pat. No. 3,187,297—Gluntz
U.S. Pat. No. 3,544,954—Yeager
U.S. Pat. No. 4,168,880—Tesch The Agron patent shows a contact retention clip mounted in a groove in a contact in a manner somewhat similar to the invention to be described herein.

Each of the prior art retention assemblies disclosed in the foregoing patents has the disadvantage that the contact clip is formed of metal so that the retention tines thereon are prone to damage during handling and assembling of the clips on the contacts, and mounting of the contacts in the connector insulator. In addition, the edges of the tines are relatively sharp which may result in the rubber grommet on the rear of the insulator being cut when the contact is pushed into the contact passage. Also, the retention tines provide relatively narrow rearwardly facing stop surfaces for engaging the forwardly facing shoulder in the contact passage so that the push-out force for the contact may be somewhat less than that desired for some applications. In addition, because the retention clips are normally somewhat loose on the contacts, EMI noise may be caused by the metal-to-metal vibration occurring during use. Further, the prior art contact retention clips are not readily field replaceable if they become damaged, thus requiring the entire contact to be replaced.

It is the object of the present invention to provide an improved front release contact retention assembly which overcomes the disadvantages of the prior art arrangements discussed above.

SUMMARY OF THE INVENTION

According to a principal aspect of the present invention, there is provided a front release contact retention assembly in which the retention ring is mounted in an annular groove in the contact in front of a forwardly facing shoulder formed in the wall of the contact passage in a connector insulator. The ring is formed of plastic, and embodies inner and outer rearwardly extending skirts. The outer skirt surrounds the inner skirt. The inner skirt lies in the groove to retain the ring axially on the contact. The outer skirt is radially deflectable, and extends outwardly to engage the shoulder in the contact passage to restrict rearward movement of the contact in the passage.

Because the retention ring is formed of plastic, the tines thereof will not damage the rubber grommet on the rear of the insulator when the contact is inserted therein. Furthermore, the plastic tines are not prone to damage during assembly and handling as are metal tines, which may be permanently bent. Also, the plastic retention ring eliminates the metal-to-metal vibration problem inherent in some prior art contact retention assemblies utilizing metal clips. Further, the plastic clip of the present invention is relatively inexpensive to manufacture, and may be replaced on the contacts in the field without difficulty.

DESCRIPTION OF THE PREFERRED EMBODIMENTS

Figure 1:
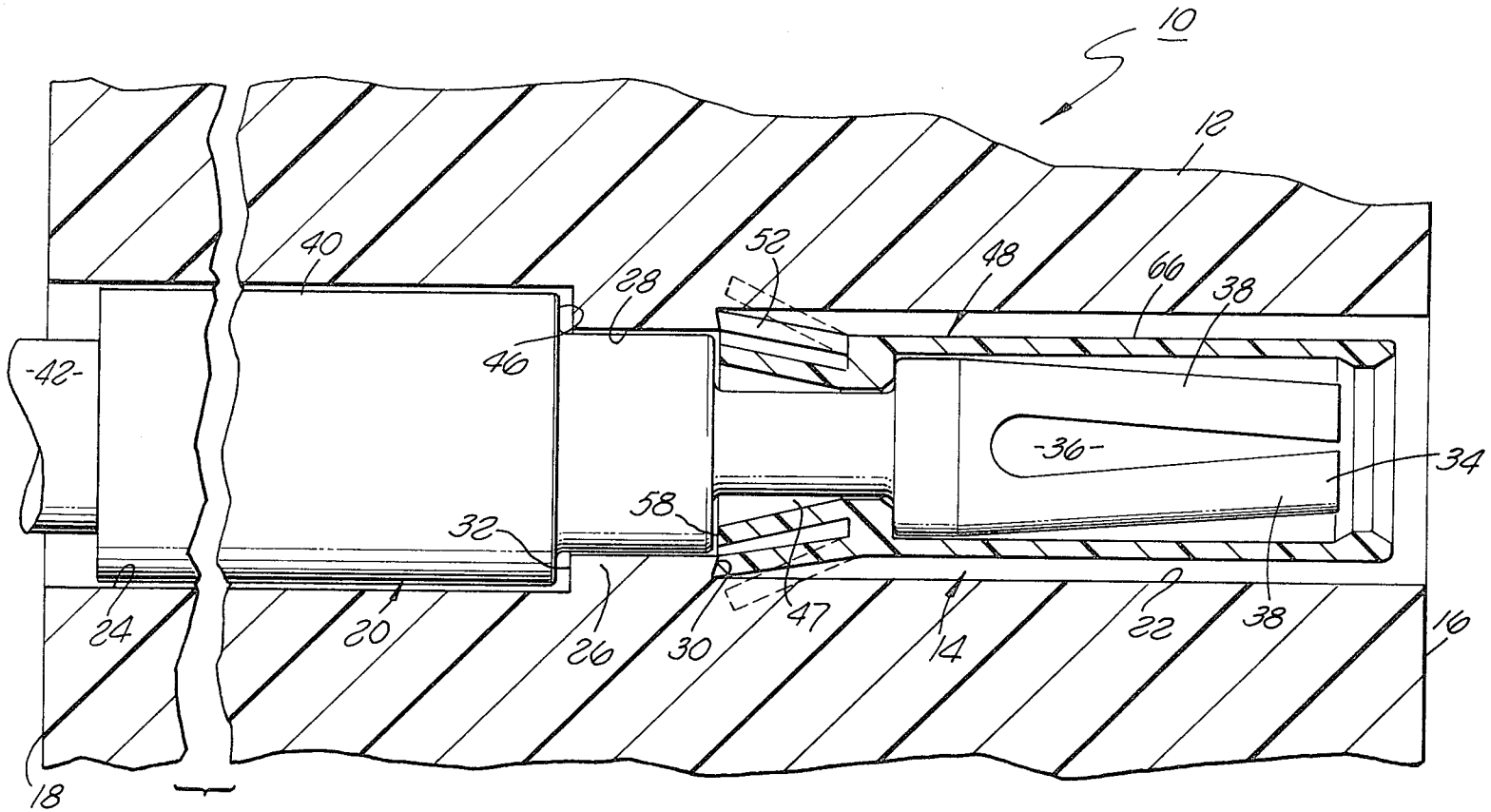
FIG. 1 is a fragmentary, partial longitudinal sectional view through an electrical connector embodying one form of the contact retention assembly of the present invention, the contact therein being in the form of a socket contact.
Figure 2:
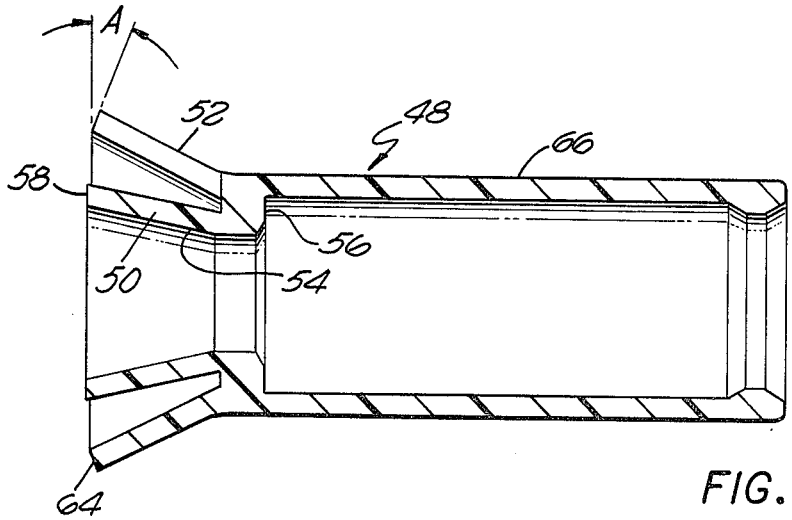
FIG. 2 is a longitudinal sectional view through the retention ring shown in FIG. 1.
Figure 3:
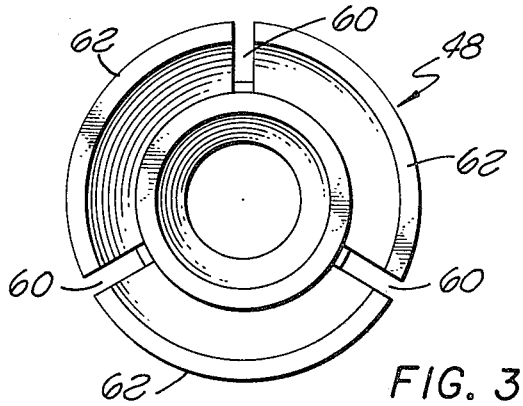
FIG. 3 is a rear end view of the ring illustrated in FIG. 2.

Referring now to FIGS. 1–3 in detail, there is shown an electrical connector member, generally designated 10, which embodies the contact retention assembly of the present invention. The connector comprises an insulator 12 having a contact passage 14 therein which extends from the front face 16 to the rear face 18 of the insulator. A contact, generally designated 20, is mounted in the passage 14.

The contact passage 14 includes a forward section 22 opening at the front face 16 of the insulator and a larger diameter rear section 24 opening at the rear face 18. A radially inwardly extending annular flange 26 separates the forward and rear sections of the passage, providing therebetween a reduced diameter section 28. The flange provides a forwardly facing annular shoulder 30 and a rearwardly facing annular shoulder 32. Each shoulder lies in a plane perpendicular to the axis of the contact passage.

In this embodiment, the contact is shown as having a forward mating end 34 in the form of a socket which is adapted to slidably receive therein a pin of a mating connector member (not shown) when the connector members are interengaged. The socket 34 is formed with two longitudinally extending slots 36 (only one being seen in FIG. 1) providing two independently movable spring beams 38. The rear termination end 40 of the contact is connected to a conductor 42, such as by crimping or soldering, which extends outwardly through the rear of the passage 14.

The contact embodies a central section 44 between the forward mating end 34 and rear termination end 40. The central section has a diameter less than that of the rear termination end 40 thereby forming a forwardly facing annular surface 46. When the contact is fully inserted into the passage 14, the central section 44 thereof is positioned in the reduced diameter section 28 of the passage, and the forwardly facing surface 46 on the contact is immediately adjacent to or abuts the rearwardly facing shoulder 32 in the contact passage thereby restricting forward movement of the contact therein.

An annular groove 47 is formed in the intermediate section 44 of the contact immediately behind the socket portion 34. The novel retention ring of the present invention, generally designated 48, is mounted in the groove 47 and thus is carried by the contact. The ring is a one-piece molded plastic part. By way of example only, the ring may be formed of polysulfone, polyamide-imide, or polyethersulfone.

As best seen in FIGS. 2 and 3, the ring 48 embodies an inner skirt 50 and an outer skirt 52 which surrounds the inner skirt. Each of the skirts has a frusto-conical configuration. Since the skirts are formed of plastic, they are radially deflectable. In addition, the plastic is sufficiently resilient so that when the ring is pushed over the forward mating end 34 of the contact, it will expand until the ring enters the groove 46 whereupon it will contract into the position illustrated in FIG. 1. The frusto-conical inner skirt 50 provides a tapered inner surface 54 which facilitates the assembly of the ring onto the contact. When the ring snaps into the groove 46, the forward face 56 of the ring abuts the front edge of the groove while the rear end 58 of the inner skirt engages the rear of the groove thereby retaining the ring axially on the contact.

Preferably, the outer skirt 52 is formed with a plurality of longitudinally extending slots 60, three being shown by way of example only. The slots define therebetween three independently movable contact retention fingers 62. The outer portions of the fingers extend outwardly beyond the circumference of the intermediate section 44 of the contact as illustrated in FIG. 2 and as shown in dotted lines in FIG. 1. When the contact is inserted into the passage 14 from the rear of the insulator 12, the fingers 62 will contract when they pass through the reduced diameter section 28 of the contact passage. Thereafter, the fingers will expand radially outwardly in front of shoulder 30 to the position illustrated in FIG. 1 engaging the wall of forward section 22 of the passage. The rear ends 64 of the fingers provide a substantially continuous rearwardly facing annular stop surface which engages the shoulder 30 thereby restricting rearward movement of the contact in the passage.

As seen in FIG. 2, the rear ends 64 of the fingers 62 are normally disposed at an "A" selected such that when the contact is mounted in passage 14 with the fingers contracted inwardly by engagement with the wall of forward section 22 of the passage, the rear ends of the fingers will be in a plane perpendicular to the axis of the contact passage and parallel to the shoulder 30 in the passage. Thus, the rear ends of the fingers are flush with the shoulder 30 thereby minimizing the retention force of the fingers.

The ring 40 embodies a forwardly extending integral cylindrical hood 66 which extends over the socket contacting portion 34 of the contact. The hood embodies an inwardly extending annular flange 68 in front of the socket 34 which protects the spring beams 38 from being damaged by electrical probes or the like.

The contact may be removed from the insulator by inserting a suitable cylindrical tool, not shown, through the forward end of the contact passage over the hood 66 to deflect the fingers 62 of the outer skirt radially inwardly out of engagement with the shoulder 30.

It will be appreciated that the longitudinal slots in the outer skirt facilitate collapsing of the skirt by the release tool so that the contact may be easily withdrawn from the contact passage in the insulator. Likewise, the slotted outer skirt facilitates forward insertion of the contact into the passage. However, if the plastic material is sufficiently pliant, the slots in the outer skirt could be eliminated.

Figure 5:
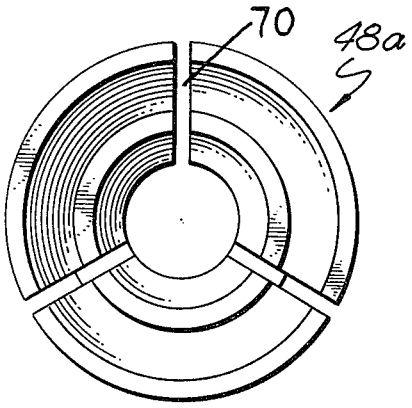
FIG. 5 is a rear end view of the ring illustrated in FIG. 4.
Figure 4:
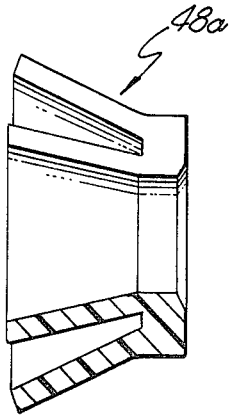
FIG. 4 is a longitudinal sectional view through a modified form of the retention ring of the present invention which may be utilized with a pin contact matable with the socket contact illustrated in FIG. 1.

FIGS. 4 and 5 illustrate a modified form of the retention ring of the present invention, generally designated 48*a*, which differs from the ring 48 in that the hood 66 is eliminated. The ring 48*a* would be used on a pin contact (not shown) for which a hood is not required. The ring would be mounted in an annular groove in the body of the pin contact in the same fashion that the ring 48 is mounted in the groove 46 in contact 20. If desired, to facilitate expansion of the ring over the contact body when mounting the ring thereon, a longitudinal slot 70 may be formed through the length of the ring, as seen in FIG. 5. The ring 48 could also be provided with such a slot. The longitudinal slot may be necessary if the plastic ring is not sufficiently resilient to allow the ring to be easily mounted over the forward end of the contact.

It will be appreciated that because the outer skirt 52 of retention ring 48 provides a substantially continuous rearwardly facing stop surface 64 which engages flush with the shoulder 30 in the contact passage, the contact retention arrangement of the present invention will be capable of withstanding very high contact push-out forces. Yet the ring is inexpensive to manufacture, easy to assemble on the contact and is not prone to damage.

What is claimed is:

1. A front release contact retention assembly comprising:

an insulator having a passage extending therethrough from a front face to a rear face thereof;

said passage having a forwardly facing shoulder therein;

a contact mounted in said passage having an annular groove therein in front of said shoulder;

a plastic retention ring mounted on said contact, said ring embodying inner and outer rearwardly extending circular skirts, said outer skirt surrounding said inner skirt;

said inner skirt lying in said groove to retain said ring axially on said contact; and said outer skirt being radially deflectable and extending outwardly to engage said shoulder to thereby restrict rearward movement of said contact in said passage.

2. A contact retention assembly as set forth in claim 1 wherein:

said ring is a one-piece molded part.

3. A contact retention assembly as set forth in claim 1 wherein:

said outer skirt has a frusto-conical configuration providing a substantially continuous rearwardly facing annular stop surface engaging said shoulder.

4. A contact retention assembly as set forth in claim 3 wherein:

said passage embodies a radially inwardly extending annular flange providing said forwardly facing shoulder, a rearwardly facing shoulder and a reduced diameter section in said passage between said shoulders; and said outer skirt contains a plurality of longitudinally extending slots whereby said outer skirt will readily contract when said ring passes through said reduced diameter section during insertion of said contact forwardly into said passage.

5. A contact retention assembly as set forth in claim 4 wherein:

said contact embodies a forwardly facing surface behind said groove engaging said rearwardly facing shoulder in said passage to thereby restrict forward movement of said contact in said passage.

6. A contact retention assembly as set forth in claim 1 wherein:

said inner skirt has a frusto-conical configuration providing a tapered inner surface for facilitating mounting of said ring on said contact.

7. A contact retention assembly as set forth in claim 1 wherein:

said contact has a socket contacting portion in front of said groove; and said ring embodies a hood extending forwardly over said socket portion, said hood embodying an inwardly extending annular flange in front of said socket portion.

8. An electrical contact comprising:

a conductive contact body having a forward mating end and a rear termination end;

an annular groove in said body between said ends;

a plastic retention ring mounted on said contact body, said ring embodying inner and outer rearwardly extending circular skirts, said outer skirt surrounding said inner skirt;

said inner skirt lying in said groove to retain said ring axially on said contact body; and said outer skirt being radially deflectable and extending outwardly for engaging a shoulder in a contact passage in which the contact is adapted to be mounted.

9. An electrical contact as set forth in claim 8 wherein:

said ring is a one-piece molded part.

10. An electrical contact as set forth in claim 8 wherein:

said outer skirt has a frusto-conical configuration providing a substantially continuous rearwardly facing annular stop surface.

11. An electrical contact as set forth in claim 10 wherein:

said outer skirt contains a plurality of longitudinally extending slots whereby said outer skirt is readily contractible.

12. An electrical contact as set forth in claim 8 wherein:

said inner skirt has a frusto-conical configuration providing a tapered inner surface for facilitating mounting of said ring on said contact body.

13. An electrical contact as set forth in claim 8 wherein:

said forward mating end is a socket; and said ring embodies a hood extending forwardly over said socket, said hood embodying an inwardly extending annular flange in front of said socket.

* * * * *